US006578956B1

(12) United States Patent
Hosaka

(10) Patent No.: US 6,578,956 B1
(45) Date of Patent: Jun. 17, 2003

(54) INK JET RECORDING HEAD AND INK JET RECORDING APPARATUS

(75) Inventor: Ken Hosaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,457

(22) Filed: Apr. 28, 2000

(65) Prior Publication Data

(65)

(30) Foreign Application Priority Data

Apr. 30, 1999 (JP) ..... 11-123568

(51) Int. Cl.[7] ..... B41J 2/175; B41J 2/165
(52) U.S. Cl. ..... 347/86; 347/87; 347/29
(58) Field of Search ..... 347/86, 87, 29

(56) References Cited

U.S. PATENT DOCUMENTS 5,262,802 A * 11/1993 Karita et al. ..... 347/86
5,917,514 A * 6/1999 Higuma et al. ..... 347/29
6,151,051 A * 11/2000 Ikeda et al. ..... 347/86

FOREIGN PATENT DOCUMENTS

EP 0638426 A1 * 2/1995 ..... B41J/2/175
JP 61-59911 3/1986
JP 61-59912 3/1986
JP 61-59913 3/1986
JP 61-59914 3/1986
JP 9-70982 A * 3/1997 ..... B41J/2/175

* cited by examiner

*Primary Examiner*—Hai Pham
*Assistant Examiner*—Manish Shah
(74) *Attorney, Agent, or Firm*—Fitzpatrick, Cella, Harper & Scinto

(57) ABSTRACT

A ink jet recording head has a discharge port forming member, an ink supply member for supplying ink into the discharge port forming member from an ink container, an ink discharge port formed by the discharge port forming member, and discharge pressure generation means for generating a discharge pressure for discharging ink from the discharge port. A discharge port forming face of the discharge port forming member and a face of the ink supply member are substantially coplanarly connected, and a protective member is adhered over both faces. The adhering area of the protective member per unit area of the ink supply member is smaller than that on the discharge port forming face.

14 Claims, 9 Drawing Sheets

INK JET RECORDING HEAD AND INK JET RECORDING APPARATUS

BACKGROUND OF THE INVENTION

Field of the Invention

The present invention relates to an ink jet recording head and an ink jet recording apparatus capable of forming an image by discharging ink onto a recording medium, and is intended to ensure that when a protective member is peeled off from a recording head when the header is mounted on the recording apparatus, adhesive material is not deposited in the vicinity or periphery of the ink discharge port, since ink discharge failure can result from such adhesive material remaining in that vicinity.

Recording utilizing an ink jet system recording head is widely employed as an image recording apparatus for information communication equipment such as printers, plotters, copying apparatus, word processors, facsimile apparatus, etc. Among such ink jet systems, the so-called bubble jet system utilizing the pressure of a bubble generated by an electrothermal converting member (as disclosed in Japanese Patent Applications Laid-Open Nos. 61-59911 to 61-59914) has the advantages of easily achieving compactization of the apparatus and a high image density in the images produced using such a system.

Such a recording head has the possibility of causing unstable ink discharge, resulting in the deterioration of print quality, due to:

1) adhesion of dust or the like in the ink discharge port of the recording head in the course of delivery (shipment) from the factory to the user through the transportation and warehouse storage;
2) evaporation of a part of the components of the ink in the vicinity of the discharge port, resulting in an increase in ink viscosity;
3) leakage of ink from the discharge port due to vibration, or being dropped, during transport; and
4) deformation of the discharge port due to mechanical shock in the course of transport.

In order to prevent such phenomena and to ensure the reliability of the printing operation, there has been adopted a method of applying a protective member in the vicinity of the discharge port and on the surrounding members, and further providing a cap member.

However, at the mounting of the recording head on the recording apparatus by the user, in order that the user does not forget to peel off the protective member, and in order that the protective member has a sufficient length to facilitate peeling by the user, there has been adopted a method of covering a peripheral area considerably larger than the necessary portion with a protective member in order to shield the discharge port from the exterior.

Such protective member is generally composed of a film substrate coated with an adhesive material, but, in consideration of the cost and efficient production of the protective member, there is employed an protective member bearing adhesive material not only on the necessary portion but on the entire surface to be attached to the recording head.

In such case, the adhesive material of the protective member adheres not only in the vicinity of the discharge port but also on the peripheral members over a considerably wire area, and, if the adhesive material adheres strongly to the recording head, for example, in the course of transportation after shipment from the factory, the adhesive material or a part thereof remains on the recording head at the peeling off of the protective member by the user, with the result that the recording head is mounted on the recording apparatus in a state bearing the adhesive material in the vicinity of or around the discharge port.

As a result, the adhesive material may directly cover the discharge port, and induce failure in the ink discharge, and the adhesive material remaining in the vicinity of the discharge port may be pushed thereinto by the wiping operation of the cleaning blade, resulting in failure in ink discharge or instability in the ink discharging angle, thereby significantly degrading the print quality.

SUMMARY OF THE INVENTION

In consideration of the foregoing, the object of the present invention is to avoid, with an extremely simple configuration, defective ink discharge resulting from adhesion of the adhesive material in the vicinity of or around the discharge port when the user peels off the protective member in mounting the recording head on the recording apparatus, thereby securely preventing defective printing inexpensively and providing an ink jet recording head and an ink jet recording apparatus of higher reliability.

The foregoing object can be attained, according to the present invention, by a configuration of the ink jet recording head including a discharge port forming member for forming an ink discharge port, an ink supply member for supplying ink to the discharge port forming member from an ink container, an ink discharge port formed by the discharge port forming member and discharge pressure generating means for generating a discharge pressure for discharging ink from the discharge port, where a discharge port forming face of the discharge port forming member and a face of the ink supply member are substantially coplanarly connected, a protective member is adhered to both faces, and the adhering area of the protective member per unit area of the ink supply member is smaller than that in the discharge port forming face.

In another aspect, in the ink jet recording head of the present invention, the adhering area per unit area is decreased in the vicinity of the ink discharge port by forming an irregularity on the surface of the protective member adhering to a portion of the surface other than the vicinity of the discharge port.

In another aspect of the present invention, the adhering area of the protective member per unit area other than the vicinity of the ink discharge port does not exceed 30%, preferably 10%, of the adhesive area of the protective member per unit area in the vicinity of the ink discharge port.

In still another aspect of the present invention, the adhering area per unit area is decreased in the vicinity of the ink discharge port by forming a fine irregularity on a portion of the surface other than the vicinity of the discharge port, on which the protective member is to be adhered.

In still another aspect of the present invention, the adhering area per unit area is decreased in the vicinity of the ink discharge port by forming plural recesses of a circular shape or a polygonal shape, such as a tetragonal shape, on a portion of the surface other than the vicinity of the discharge port, on which the protective member is to be adhered.

Alternatively, that the smaller adhesive area in the vicinity of the ink discharge port is attained by forming a plurality of grooves parallel to an array of the discharge ports, on a portion of the surface other than the vicinity of the discharge port, on which the protective member is to be adhered, or by forming a plurality of grooves unparallel to an array of the discharge ports, on the surface portion other than the vicinity of the discharge port, on which the protective member is to be adhered.

According to another aspect of the present invention, the protective member, in peeling perpendicularly to the face of the ink supply member and the discharge port forming face in succession in this order, has a vertical peeling adhesive force not exceeding 120 gf, preferably 80 gf, on the surface portion other than the vicinity of the discharge port.

Also, in the ink jet recording head of the present invention, the pressure generating means may be an electrothermal converting member.

In an ink jet recording apparatus of the present invention, the recording head may be arranged to have the features of any of the above-mentioned ink jet recording heads of the present invention.

DESCRIPTION OF THE PREFERRED EMBODIMENTS

Owing to the above-mentioned configurations, the present invention prevents, in peeling off the protective member by the user, the adhesive material from remaining in the vicinity of or around the discharge port, and thus easily and simply realizes improvement in the print quality and reliability without an increase in the cost of the component parts.

In the following the present invention will be clarified by description of the preferred embodiments thereof.

[Embodiment 1]

Figure 7:
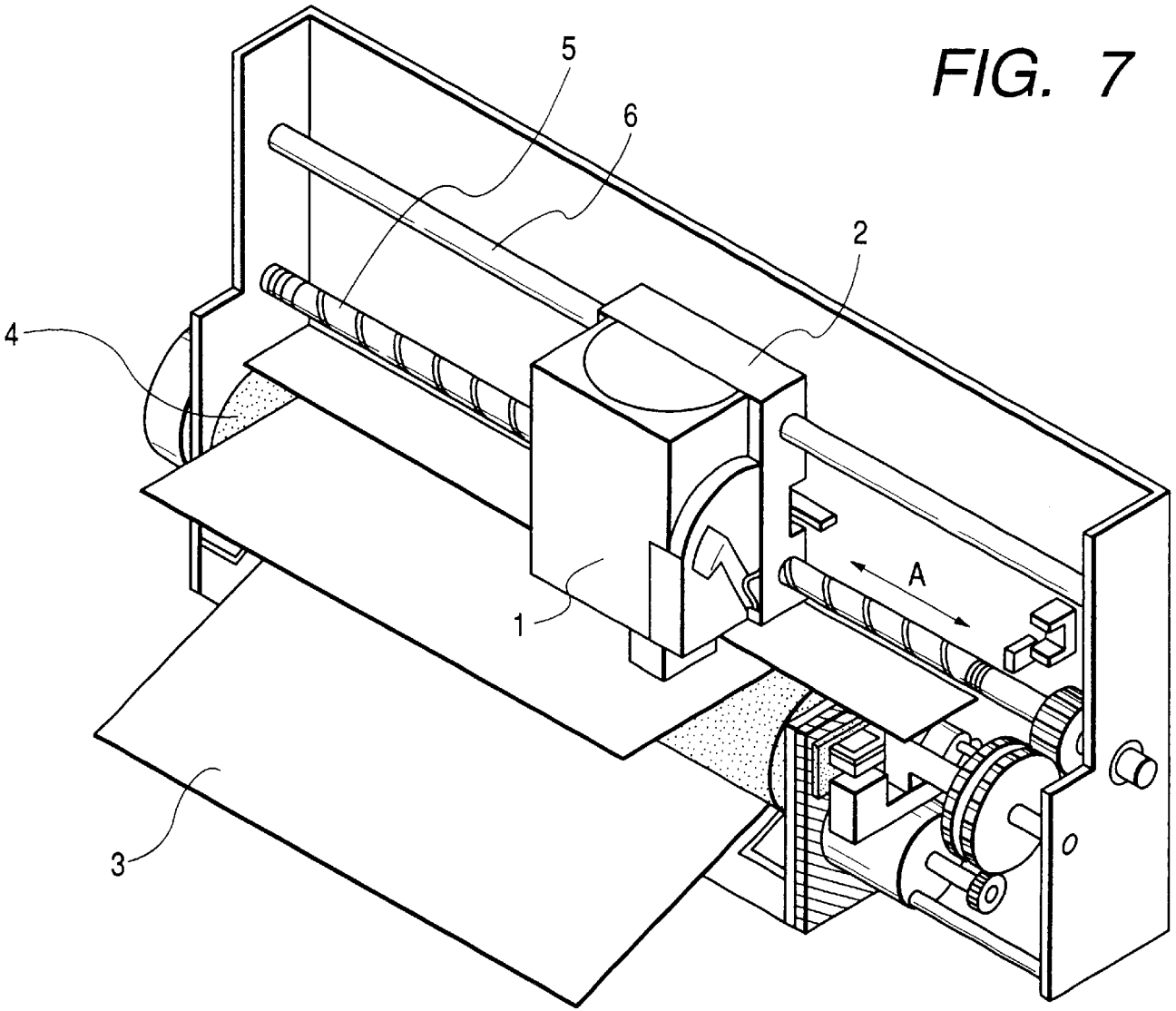
FIG. 7 is a schematic perspective view of an ink jet apparatus of the present invention.

FIG. 7 is a schematic perspective view showing an ink jet recording apparatus on which the recording head of the present invention can be mounted. In FIG. 7 there are shown an ink jet recording head 1, a carriage 2 on which the ink jet recording head is fixed and which enables electrical connection when the ink jet recording head is fixed, a recording medium 3 such as paper on which recording is carried out, and which is conveyed by a conveying roller 4 in a direction perpendicular to the scanning direction (A) of the ink jet recording head 1, and shafts 5, 6 for guiding the scanning motion of the carriage 2 and adapted to be rotated for moving the carriage 2.

Figure 8:
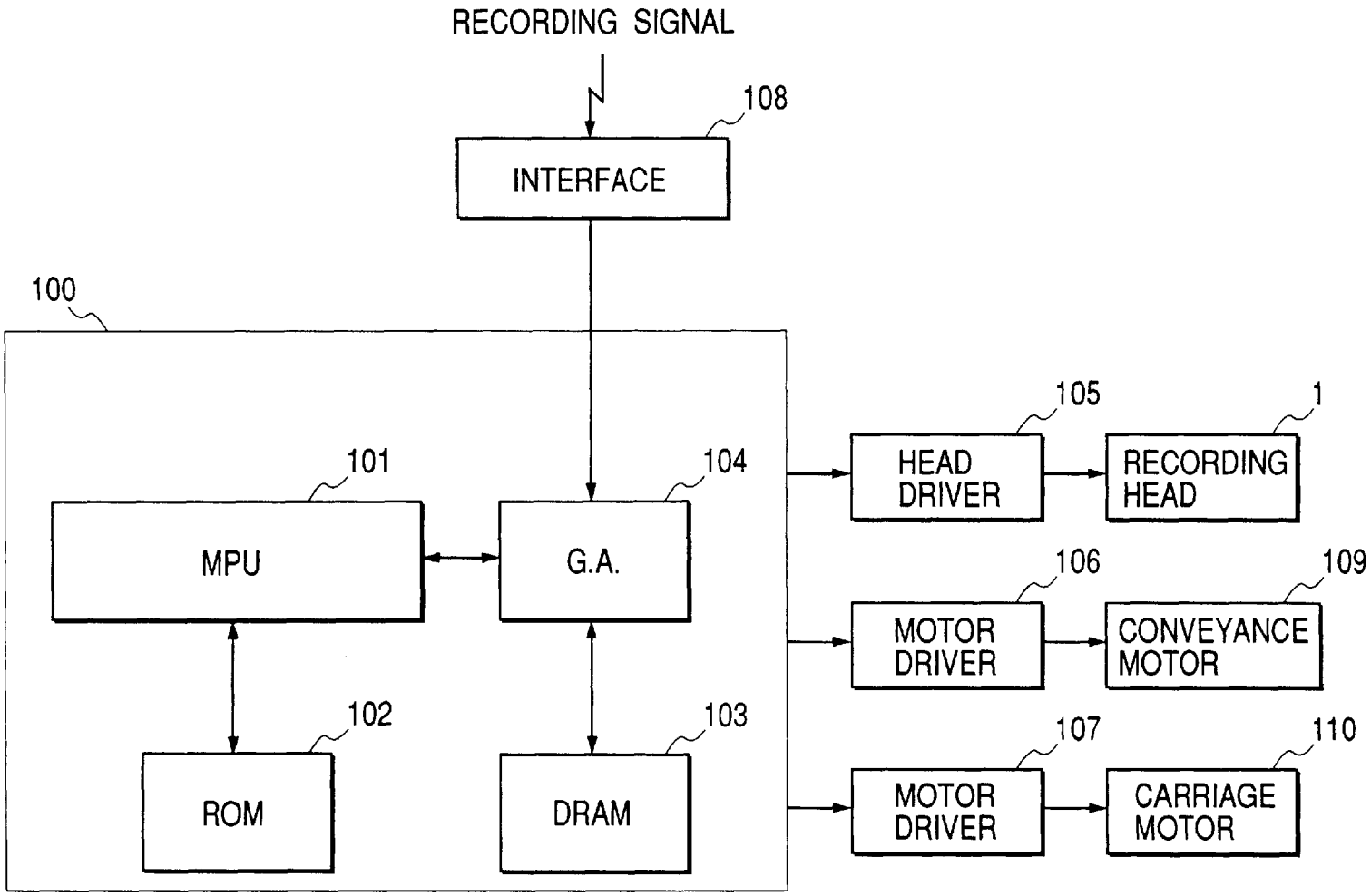
FIG. 8 is a block diagram showing the configuration of a control circuit of the ink jet apparatus shown in FIG. 7.

FIG. 8 is a block diagram showing the configuration of a control circuit 100 of the ink jet recording apparatus shown in FIG. 7. In FIG. 8, there are shown an interface 108 for entering a recording signal, a MPU 101, a ROM 102 storing a control program to be executed by the MPU 101, a DRAM 103 storing various data such as the recording signal and the recording data to be supplied to the ink jet recording head 1, a gate array (G.A.) 104 for controlling the supply of the recording data to the ink jet recording head 1 and also controlling the data transfer from the interface 108, MPU 101 and RAM 103, a carriage motor 110 for causing the scanning motion of the carriage supporting the ink jet recording head 1, a conveying motor 109 for conveying the recording medium, a head driver 105 for driving the ink jet recording head 1, and motor drivers 106, 107 for respectively driving the conveying motor 109 and the carriage motor 110. In the above-described control circuit, when the recording signal is entered into the interface 108, it is converted into recording data for printing between the gate array 104 and the MPU 101. When the motor drivers 106, 107 are driven, the ink jet recording head 1 is driven according to the recording data supplied to the head driver 105 to achieve recording.

Figure 9:
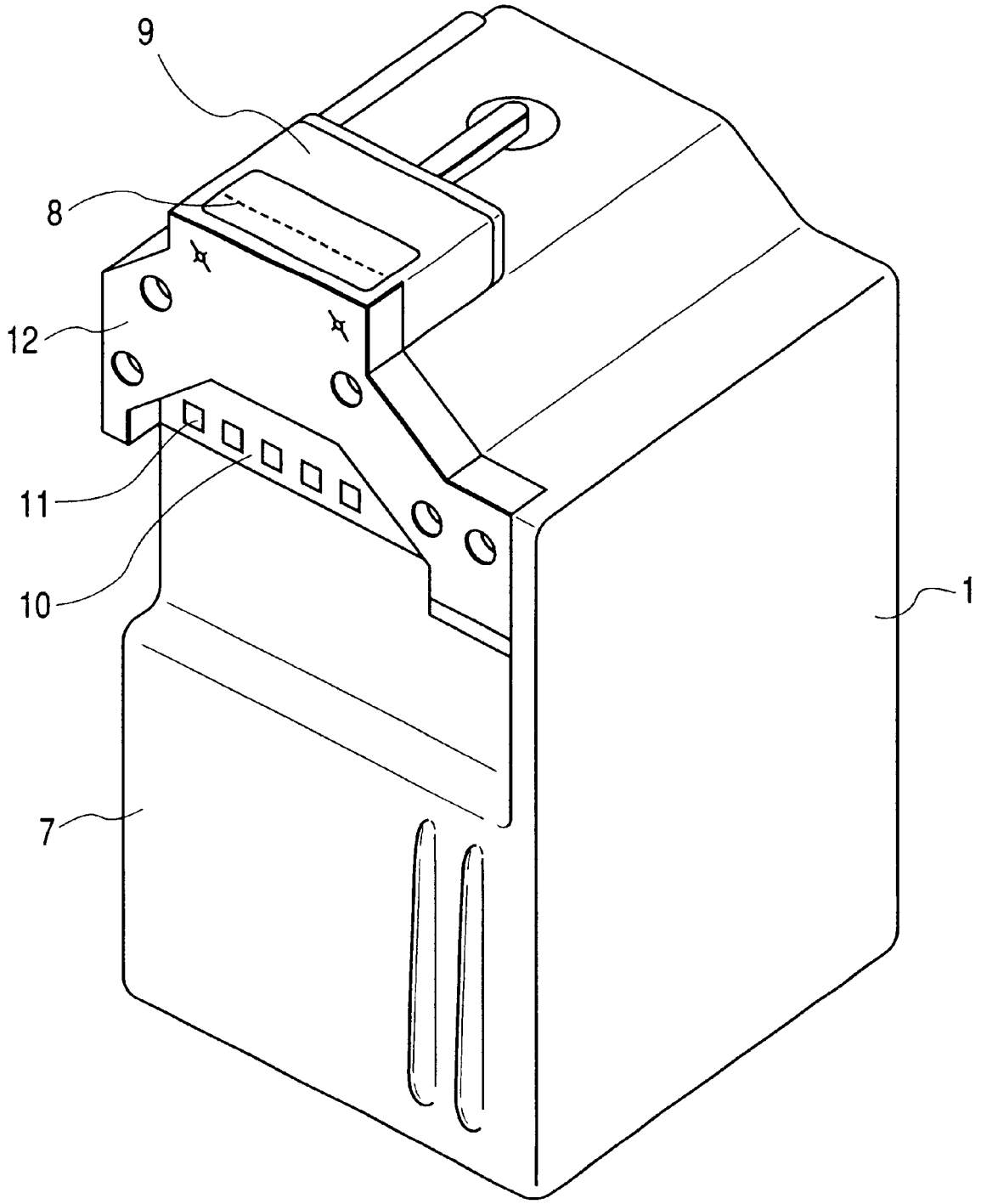
FIG. 9 is a schematic perspective view showing an example of the ink jet recording head mountable on the ink jet recording apparatus shown in FIG. 7.

In the following there will be given an explanation on the ink jet recording head. FIG. 9 is a schematic perspective view showing an example of the ink jet recording head that can be mounted on the ink jet recording apparatus shown in FIG. 7. There are shown an ink tank 7 containing ink, plural discharge ports 8 for ink discharge, an ink supply member 9, a PWB 10 connected with the heat generating elements (electrothermal converting members), a contact pad 11 to be electrically connected with the apparatus on the carriage, and a base plate 12 for mounting the abovementioned components.

Figure 10:
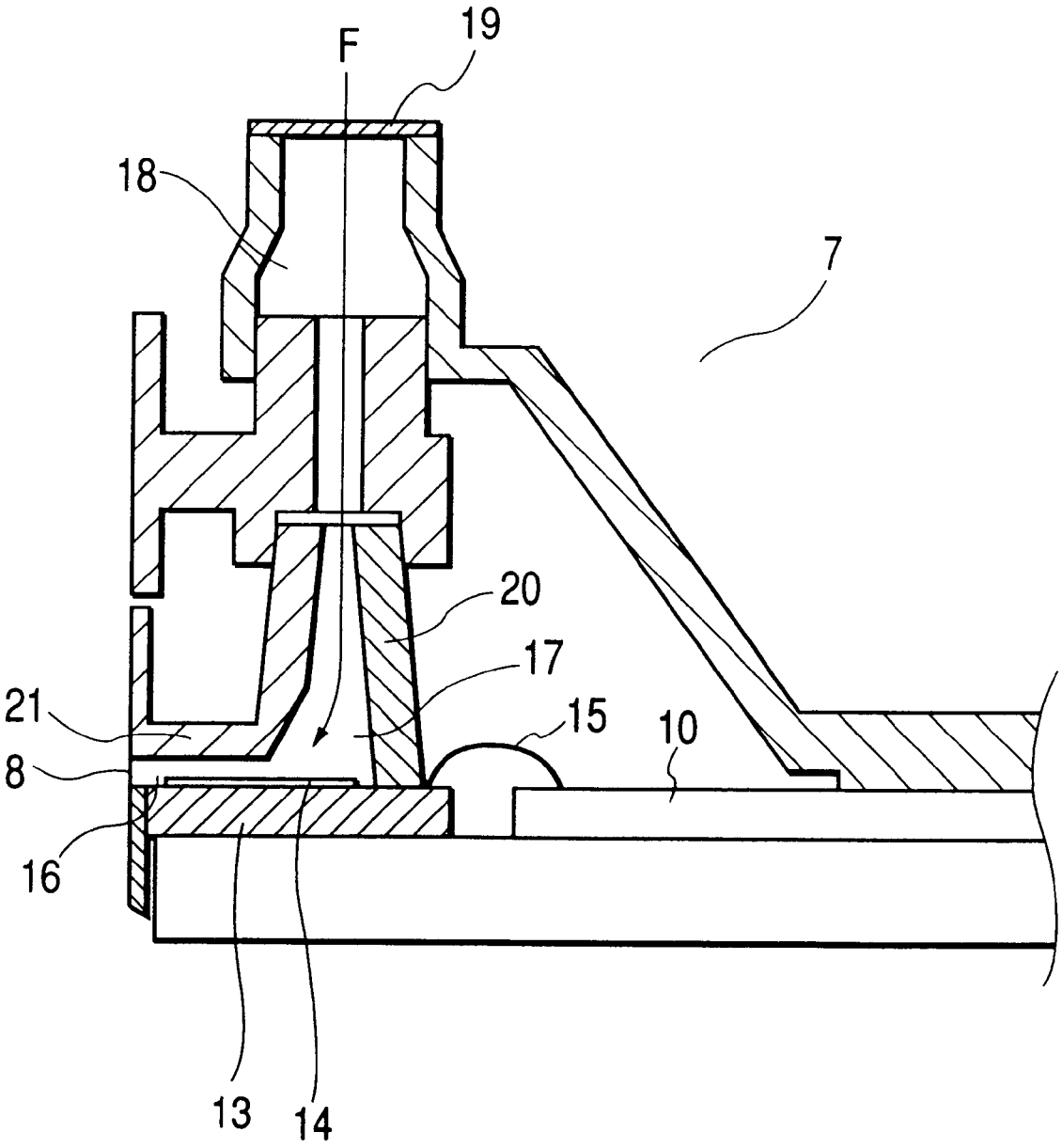
FIG. 10 is a magnified schematic view showing an example of the vicinity of the ink discharge port in the ink jet recording head of the present invention.

In the following there will be explained the details around the ink discharge port. FIG. 10 is a magnified cross-sectional view, including the ink path for discharging ink and configurations required for the ink discharge. In FIG. 10, a board 13 bears a plurality of heat generating elements 14 for discharging ink by bubble generation therein (hereinafter called the "heater board"), and is electrically connected with the PWB 10 through a wire 15. A ceiling plate 20 is provided for forming a plurality of discharge ports 8 and ink paths 16 for causing ink discharge and a common liquid chamber 17 connected in common to the plural ink paths 16.

In the ink supply path 18, connecting the interior of the ink tank 7 constituting the ink container and the common liquid chamber 17 of the recording head, a filter 19 is provided at the end in the ink tank side. The ink path from the ink tank 7 to the discharge port formed by the ceiling plate 20 goes through the ink supply path 18 and the common liquid chamber 17 as indicated by an arrow F.

Figure 1:
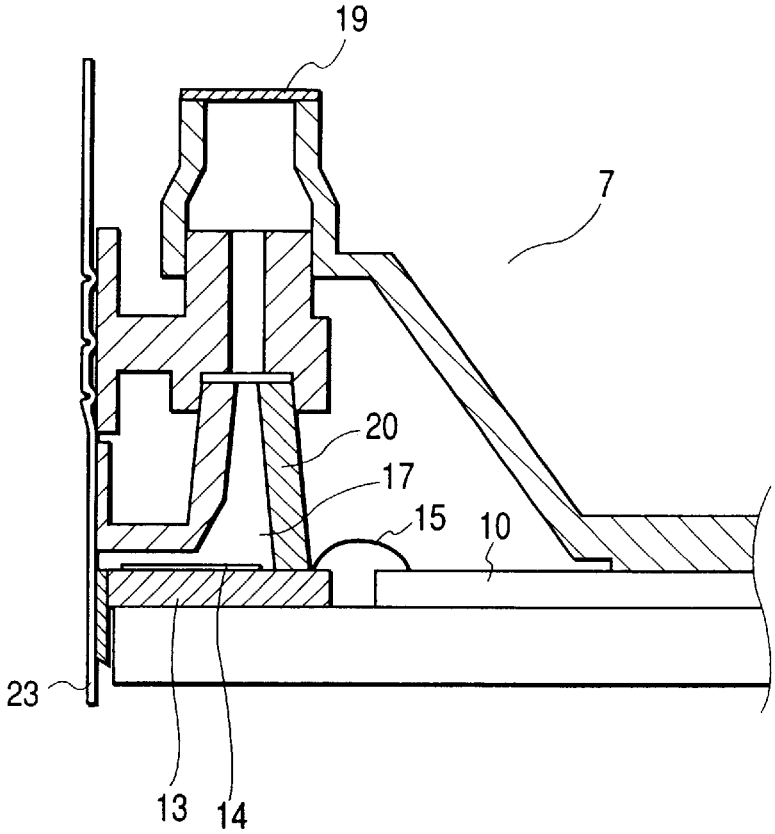
FIG. 1 is a cross-sectional view in the vicinity of the discharge port of an ink jet recording head of embodiment 1 of the present invention.

FIG. 1 is a cross-sectional view showing the configuration of the ink jet recording head in an embodiment 1 of the present invention.

Referring to FIG. 1, there is shown a protective member 23 constituted by coating an adhesive material on a film. The protective member 23 extends on three areas in the following order, namely, on an area of the discharge port forming member, an area of the ink supply member and an overhang area (non-adhered area) serving to be gripped by the user in peeling off the protective member. Irregularities are formed on the surface of the protective member adhering to the area of the ink supply member. Consequently, the adhesive material of the protective member adheres to the entire surface of the discharge port forming member in order to prevent ink leakage from the discharge port, but, in the area of the ink supply member, adheres only to a part thereof because of the irregular cross-sectional shape of the protective member. Therefore, the adhesive force per unit area is decreased in the area of the ink supply member, and, when the user peels off the protective member by gripping the overhang portion after the unpacking of the recording head, adhesive material does not remain on the recording head in the area of the ink supply member. Thus, since such remaining of the adhesive material is avoided in the area of the ink supply member which is in the initial part of the peeling operation of the protective member, the adhesive material thereafter stably remains on the protective member, so that the discharge port forming face is kept free of the adhesive material. In the present embodiment, liquid repellent treatment is applied to the discharge port forming face, thereby further facilitating to prevent adhesive material of the protective member from remaining.

Figure 2:
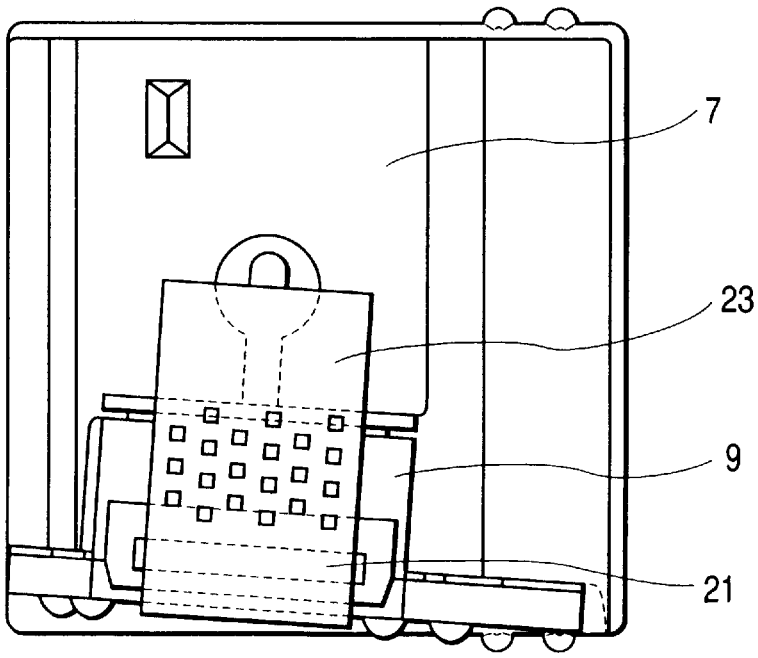
FIG. 2 is a view showing a surface irregularity pattern of a protective member for the ink jet recording head of an embodiment 1 of the present invention.

FIG. 2 is a view showing the ink discharge port and the surface therearound, wherein shown are a discharge port forming face 21 of the discharge port forming member, an ink tank 7 containing ink therein, an ink supply member 9 connected on the same plane to the discharge port forming face mentioned above, and a protective member 23 adhered onto the discharge port forming face. The protective member completely covers an area in the vicinity of the discharge port within the discharge port forming member, and, in the area of the ink supply member, is provided, on the entire surface, with a grid-shaped regular pattern as illustrated, thereby decreasing the adhering area which adheres to the ink supply member.

In such patterned surface, the adhering area per unit area becomes 20% or less in comparison with that in the vicinity of the discharge port, and the peeling strength in such patterned area was almost zero.

The illustrated irregular pattern is merely an example, and any pattern may be adopted as long as the remaining of the adhesive material can be avoided under the applicable conditions of transportation and storage.

[Embodiment 2]

Figure 3:
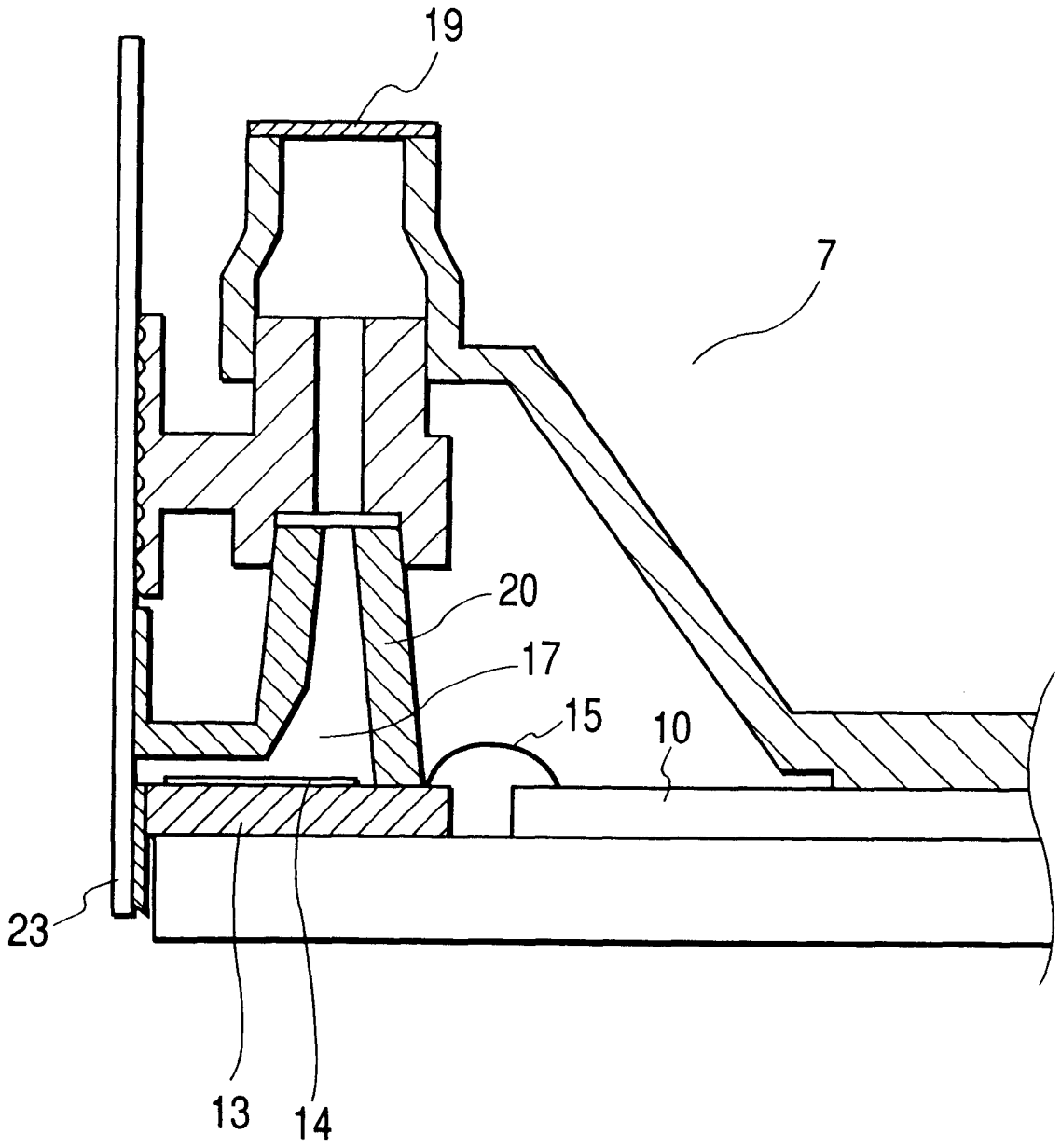
FIG. 3 is a cross-sectional view in the vicinity of the discharge port of an ink jet recording head of an embodiment 2 of the present invention.

FIG. 3 is a cross-sectional view showing the configuration of the ink jet head in an embodiment 2 of the present invention.

In the present embodiment, as shown in FIG. 3, a fine surfacially irregular pattern is formed on the area of the ink supply member on which the protective member is to be adhered, whereby the adhering area (area of adhesive) between the protective member and the ink supply member can be decreased.

Figure 4:
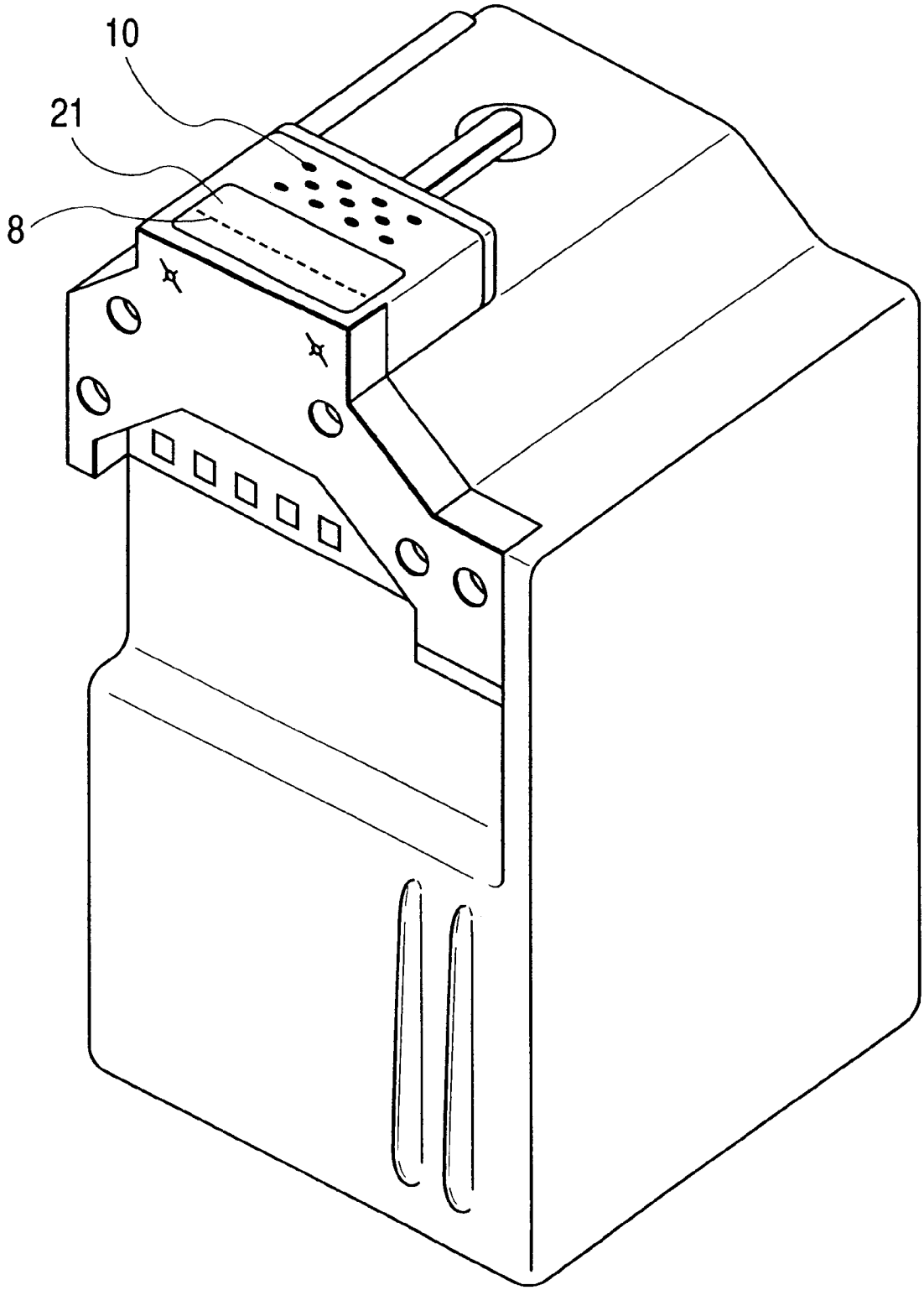
FIG. 4 is a perspective view in the vicinity of the discharge port of an ink jet recording head of embodiment 2 of the present invention.

FIG. 4 is a perspective view around the discharge port forming face of the recording head of the present embodiment.

As shown in FIG. 4, plural recesses 10 are formed in a regular pattern in the area of the ink supply member. The ink supply member is usually composed of a molded part of a plastic material, and, in such case, such patterned recesses can be obtained by forming protruding patterns on the metal mold corresponding to the face of the ink supply member on which the protective member is to be adhered, or by applying a blasting process to the metal mold if the desired pattern is fine.

[Embodiment 3]

Figure 5:
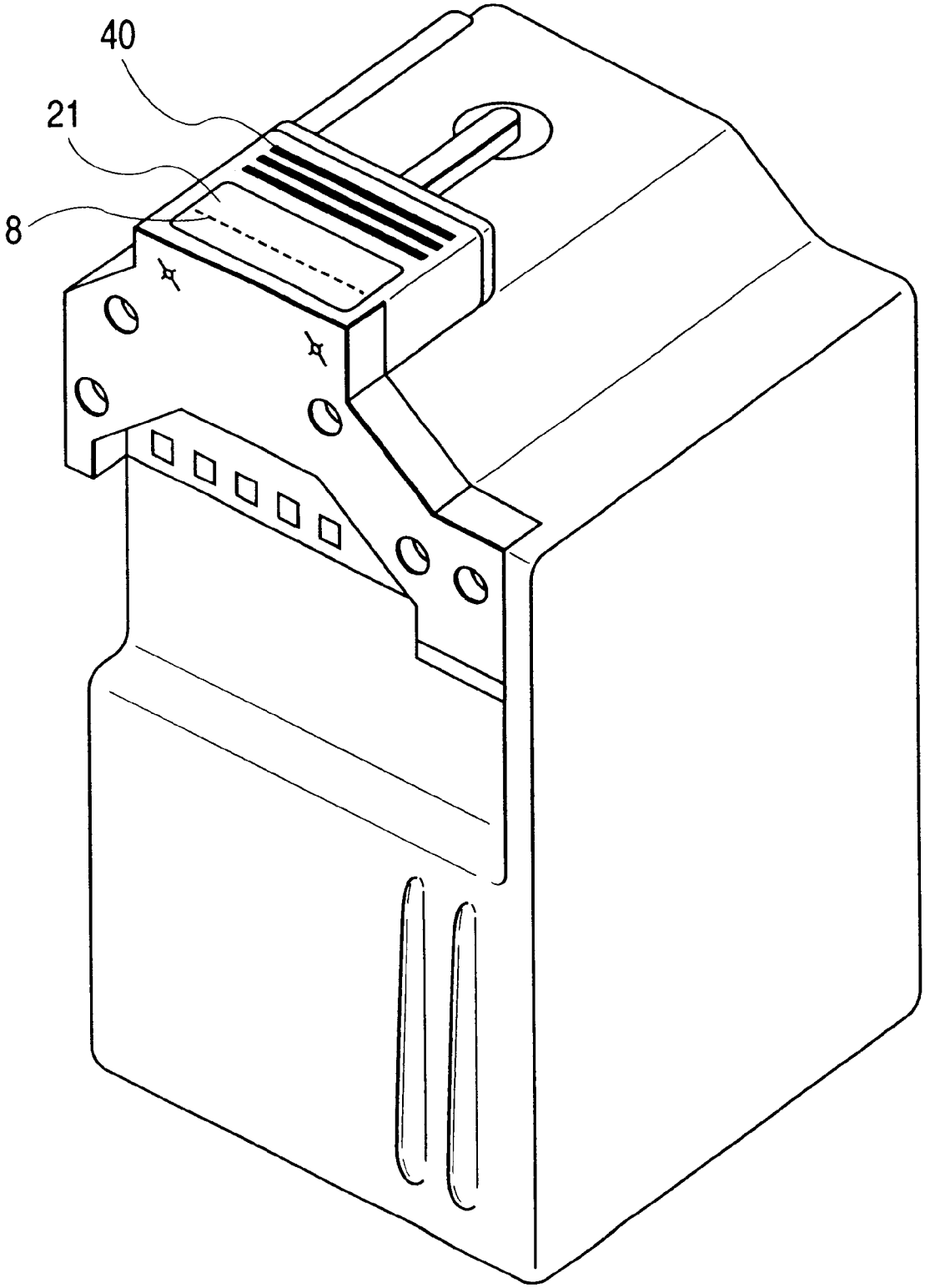
FIG. 5 is a perspective view in the vicinity of the discharge port of an ink jet recording head of an embodiment 3 of the present invention.

FIG. 5 is a perspective view showing the configuration of an embodiment 3 of the present invention.

In this embodiment, as shown in FIG. 5, the irregular surface pattern in the area of the ink supply member is obtained by forming plural parallel grooves, parallel to the array of the discharge ports. In FIG. 5, the groove is indicated by 40. The amount of adhering area per unit area can be adjusted in various manners, by varying the width of each groove or the gap between the grooves.

[Embodiment 4]

Figure 6:
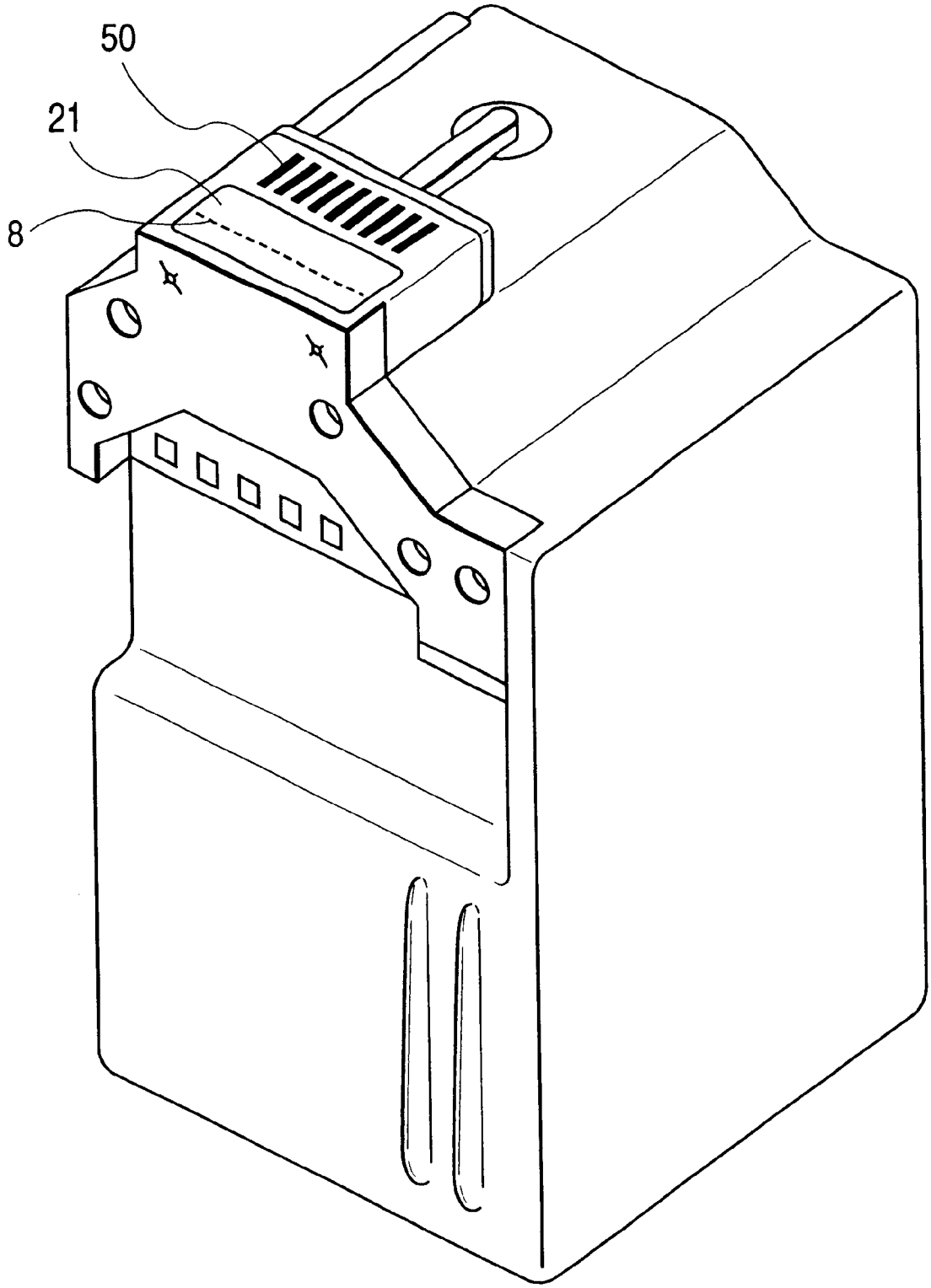
FIG. 6 is a perspective view in the vicinity of the discharge port of an ink jet recording head of an embodiment 4 of the present invention.

FIG. 6 is a perspective view showing the configuration of an embodiment 3 of the present invention. In this embodiment, the surfacial irregularity pattern formed in the area of the ink supply member is attained by forming plural parallel grooves, which are perpendicular to the array of the discharge ports. The illustrated angle of the parallel grooves with respect to the array of the discharge ports is merely an example, and any other angle may be adopted as long as the adhering area per unit area can be decreased to the target level. In FIG. 6, the grooves are indicated by 50.

According to the present invention, as explained in the foregoing, in an ink jet head in which a protective member is adhered onto both the discharge port forming face of the discharge port forming member and the face of the ink supply member, when the user peels off the protective member upon mounting the recording head onto the recording apparatus, the adhesive material can be prevented from remaining in the vicinity of or around the ink discharge port which could lead to defective ink discharge or similar phenomena, by means of an extremely simple configuration, i.e., that the adhering area of the protective member per unit area other than the vicinity of the ink discharge port is smaller than that in the vicinity of the ink discharge port, whereby the defective printing can be securely avoided with a low cost and there can be provided an ink jet recording head, and an apparatus using the head, the head and the apparatus both having improved reliability.

What is claimed is:

1. An ink jet recording head comprising a discharge port forming member, an ink supply member for supplying ink to said discharge port forming member from an ink container, an ink discharge port formed by said discharge port forming member, and discharge pressure generation means for generating a discharge pressure for discharging ink from said discharge port, in which a discharge port forming face of said discharge port forming member and a face of said ink supply member are substantially coplanarly connected and a protective member is adhered over both faces, wherein the adhering area of the protective member per unit area of said ink supply member is smaller than that on said discharge port forming face, and wherein the adhering area of the protective member per unit area on said ink supply member does not exceed 30% of the adhering area of the protective member per unit area on said discharge port forming face.

2. An ink jet recording head according to claim 1, wherein the adhering area per unit area is decreased by forming a fine irregularity on the surface of said ink supply member on which the protective member is adhered.

3. An ink jet recording head according to claim 1, wherein the adhering area per unit area is decreased by forming plural recesses of a shape selected from the group consisting of circular shape and polygonal shapes, on the surface of said ink supply member on which the protective member is adhered.

4. An ink jet recording head according to claim 3, wherein the adhering area per unit area is decreased by forming plural recesses of tetragonal shape on the surface of said ink supply member on which the protective member is adhered.

5. An ink jet recording head according to claim 1, wherein the adhering area per unit area is decreased by forming plural parallel grooves which are parallel to an array of the discharge ports, on the surface of said ink supply member on which the protective member is adhered.

6. An ink jet recording head according to claim 1, wherein said protective member is to be lifted in the order from the face of the ink supply member to the discharge port forming face.

7. An ink jet recording head according to claim 6, wherein said protective member has a vertical peeling adhesive force, on the face of said ink supply member, not exceeding 120 gf.

8. An ink jet recording head according to claim 7, wherein said protective member has a vertical peeling adhesive force, on the face of said ink supply member, not exceeding 80 gf.

9. An ink jet recording head according to claim 1, wherein liquid repellent treatment is applied to said discharge port forming face.

10. An ink jet recording head according to claim 1, wherein said pressure generation means is an electrothermal converting member.

11. An ink jet recording head according to claim 1, wherein the adhering area of the protective member per unit area on said ink supply member does not exceed 10% of the adhering area of the protective member per unit area on said discharge port forming face.

12. An ink jet recording head according to claim 1, wherein the adhering area per unit area is decreased by forming an irregularity on the surface of said protective member adhering to the face of said ink supply member.

13. An ink jet recording head comprising a discharge port forming member, an ink supply member for supplying ink to said discharge port forming member from an ink container, an ink discharge port formed by said discharge port forming member, and discharge pressure generation means for generating a discharge pressure for discharging ink from said discharge port, in which a discharge port forming face of said discharge port forming member and a face of said ink supply member are substantially coplanarly connected and a protective member is adhered over both faces, wherein the adhering area of the protective member per unit area of said ink supply member is smaller than that on said discharge port forming face, and wherein the adhering area per unit area is decreased by forming plural parallel grooves which are unparallel to an array of discharge ports, on the surface of said ink supply member on which the protective member is adhered.

14. An ink jet recording apparatus provided with an ink jet recording head for forming an image by discharging ink onto a recording medium, wherein said recording head is an ink jet recording head according to any of claims 1, 2 to 10 and 12.

* * * * *

UNITED STATES PATENT AND TRADEMARK OFFICE

CERTIFICATE OF CORRECTION

PATENT NO. : 6,578,956 B1
APPLICATION NO. : 09/559457
DATED : June 17, 2003
INVENTOR(S) : Ken Hosaka It is certified that error appears in the above-identified patent and that said Letters Patent is hereby corrected as shown below:

COLUMN 1

Line 59, “an” should read --a--; and
Line 64, “wire” shoul read --wider--.

Signed and Sealed this

Eighth Day of May, 2007

JON W. DUDAS
*Director of the United States Patent and Trademark Office*